US006247397B1

(12) United States Patent
Diotalevi

(10) Patent No.: US 6,247,397 B1
(45) Date of Patent: Jun. 19, 2001

(54) APPARATUS FOR SEPARATING LIQUID AND SOLID SUBSTANCES, PARTICULARLY FOR EXTRACTING JUICE FROM FRUIT AND THE LIKE

(75) Inventor: Franco Diotalevi, Pesaro (IT)

(73) Assignee: Siprem International Srl, Persaro (IT)

( * ) Notice: Subject to any disclaimer, the term of this patent is extended or adjusted under 35 U.S.C. 154(b) by 0 days.

(21) Appl. No.: 09/362,073

(22) Filed: Jul. 27, 1999

(30) Foreign Application Priority Data

Sep. 11, 1998 (IT) ..... MI98A1995

(51) Int. Cl.[7] ..... B30B 9/22; B30B 15/30

(52) U.S. Cl. ..... 100/71; 100/90; 100/99; 100/104; 100/116; 100/211

(58) Field of Search ..... 100/90, 99, 110, 100/116, 104, 125, 211, 71

(56) References Cited

U.S. PATENT DOCUMENTS 4,679,601 * 7/1987 Schmid ..... 100/211
5,244,567 * 9/1993 Gerteis ..... 100/211

FOREIGN PATENT DOCUMENTS

4323711 * 1/1995 (DE) .
0338230 * 10/1989 (EP) .
0524373 * 1/1993 (EP) .
597857 * 12/1925 (FR) ..... 100/71
528654 * 7/1955 (IT) ..... 100/211

* cited by examiner

*Primary Examiner*—Stephen F. Gerrity
(74) *Attorney, Agent, or Firm*—R. Neil Sudol; Henry D. Coleman; William J. Sapone

(57) ABSTRACT

An apparatus for separating liquid and solid substances, particularly for extracting juice from fruit and the like, such as grapes. The apparatus includes a pressing container into which the product to be separated is fed; the apparatus includes a cylinder which is divided by a flexible diaphragm into a pressing chamber and into a second chamber; the flexible diaphragm is adjacent to a region which is substantially at atmospheric pressure and the pressing chamber is connected to a a mechanism for generating a partial vacuum, so that the diaphragm acts on the product and presses it; the apparatus also includes a collector which is constituted by a fixed connector, which is rigidly coupled to the body of the apparatus; an air intake pipe, which is associated with the pressing container and rotates with it; a radial tubular member, which is associated with the pressing container and rotates with it; a radial tubular member, which is connected to the second chamber of the pressing container and to the air intake pipe and is in turn connected to a fan through an air manifold; an internal coaxial pipe forms an annular chamber inside the air intake pipe; the chamber is connected to the fan and to the second chamber.

13 Claims, 3 Drawing Sheets

APPARATUS FOR SEPARATING LIQUID AND SOLID SUBSTANCES, PARTICULARLY FOR EXTRACTING JUICE FROM FRUIT AND THE LIKE

BACKGROUND OF THE INVENTION

1. Field of the Invention

The present invention relates to an improved apparatus for separating liquid and solid substances, particularly for extracting juice from fruit and the like.

2. Description of the Prior Art

Grape presses are known which are constituted by a tank which is divided into a pressure chamber and into a pressing chamber by means of a flexible membrane.

The product to be processed is introduced in the pressing chamber and the pressure chamber is supplied with a pressurized fluid (air or water) so that the membrane acts on the product, pressing it. The process usually entails several pressing cycles at variable pressure and the tank can rotate to allow better draining of the product.

These conventional presses are constituted by a pressure tank and as by device for generating a pressurized fluid, which in addition to consuming considerable energy must also of course meet all the statutory standards related to this type of apparatus.

Conventional presses therefore not only have a heavy and complicated structure but must also be equipped with all the necessary safety systems provided when working in the presence of high-pressure fluids.

Presses which operate by using partial vacuum instead of high pressure have accordingly been introduced.

In this type of press, a partial vacuum is generated in the pressing chamber that contains the product, so that the membrane, pushed by ambient pressure and optionally by a slight overpressure provided in the pressure chamber, acts on the product, pressing it.

An aim of the present invention is to provide an apparatus for separating liquid and solid substances, particularly a press which operates by partial vacuum, with improved characteristics.

An object of the invention is to provide a press having a device which facilitates the repositioning of the elastic membrane of the press.

A further object is to provide a device which can be applied to a grape press and is capable of ensuring a higher quality of the processed product.

SUMMARY OF THE INVENTION

The above aim and objects, and other objects which will become apparent hereinafter, are achieved by an apparatus for separating liquid and solid substances, particularly for extracting juice from fruit and the like, comprising a pressing container into which the product to be separated is fed, characterized in that it comprises a cylinder which is divided by a flexible diaphragm into a pressing chamber and into a second chamber, the flexible diaphragm being adjacent to a region which is substantially at atmospheric pressure and the pressing chamber being connected to a vacuum means adapted to generate a partial vacuum, so that the diaphragm acts on the product and presses it, the apparatus further comprising a collector device comprising a fixed connector, which is rigidly coupled to the body of the apparatus, an air intake pipe, which is associated with the pressing container and rotates with it, a radial tubular member, which is connected to the second chamber of the pressing container and to the air intake pipe, which is in turn connected to a fan through an air manifold, an internal coaxial pipe, which forms an annular chamber inside the air intake pipe; the fan being suitable to draw air from the second chamber by means of the radial pipe, the annular chamber, the air manifold and the connector, generating a partial vacuum which is suitable to bring the diaphragm to a position which adheres to the internal surfaces of the pressing container.

Further characteristics and advantages will become apparent from the description of the apparatus, illustrated only by way of non-limitative example in the accompanying drawings.

BRIEF DECRIPTION OF THE DRAWINGS

DESCRIPTION OF THE PREFERRED EMBODIMENTS OF THE INVENTION

Figure 1:
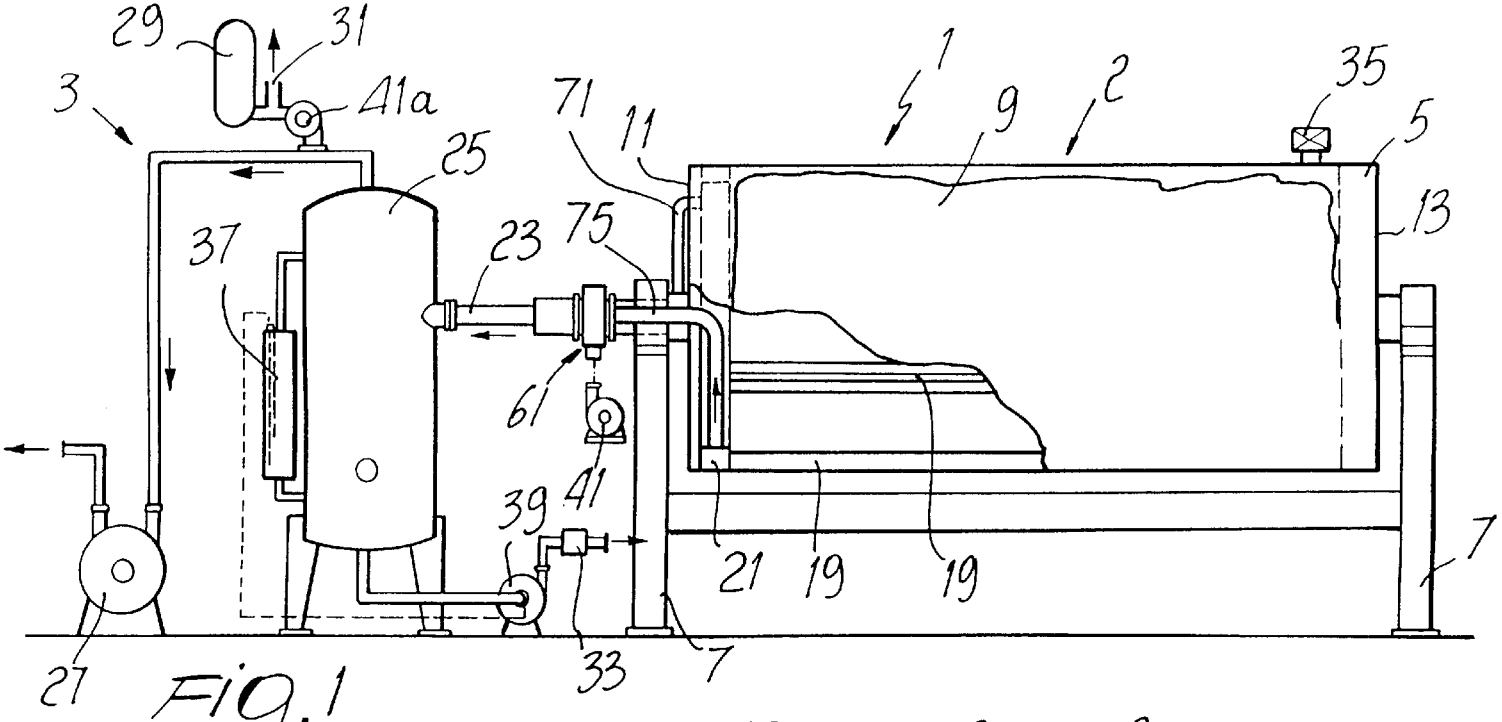
FIG. 1 is a schematic lateral elevation view of the apparatus according to the invention.

With reference to the above figures, the apparatus according to the invention, generally designated by the reference numeral 1, includes a container 2, into which the material to be separated is fed, and a vacuum generator 3 which is adapted to generate a partial vacuum in the container 2.

The container 2 is constituted by a cylindrical structure 5 which is mounted so as to be able to rotate on supports 7 and includes an elastic diaphragm 9 which is fixed along two generatrices of the cylinder and to the end walls 11 and 13 thereof, so as to form a first pressing chamber 15 and a second chamber 17.

The pressing chamber 15 includes a series of discharge ducts 19 which are perforated to allow to drain the liquid part separated during pressing.

The discharge ducts 19 are connected to a circular manifold 21 which is located at the end wall 11 and is in turn connected to a discharge manifold 23 outside the container 2.

Figure 3:
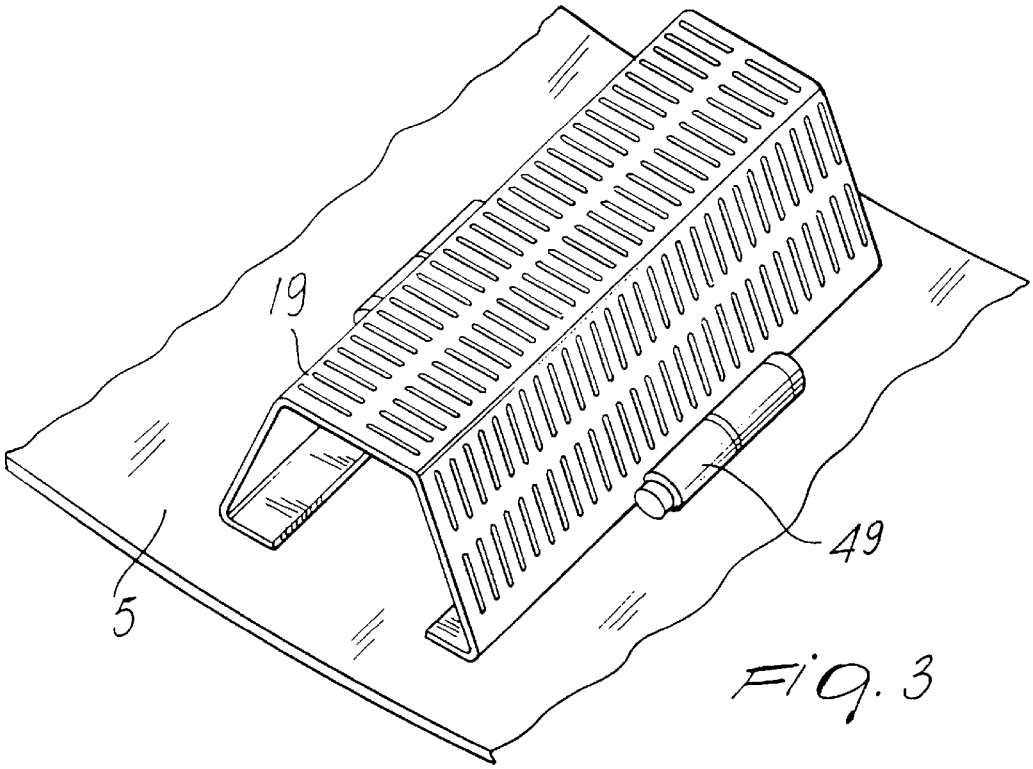
FIG. 3 is an enlarged-scale axonometric view of a detail of a discharge duct.

Advantageously, the discharge ducts 19 are applied to the tank by means of hinges 49, as shown in FIG. 3. The ducts 19 can therefore be opened easily to be cleaned without having to disassemble them, as instead occurs in conventional structures.

Figure 4:
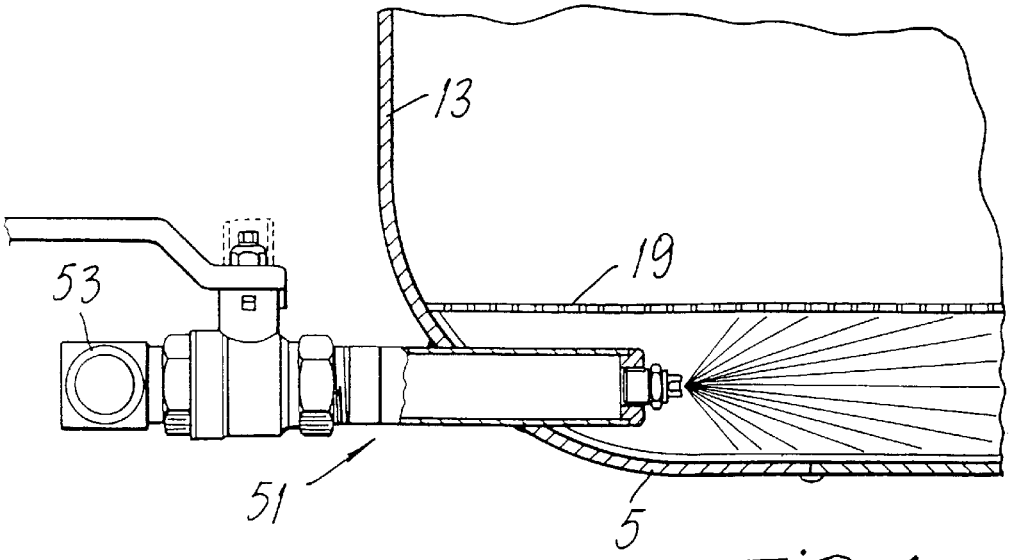
FIG. 4 is a sectional side view of a detail of a discharge duct.
Figure 5:
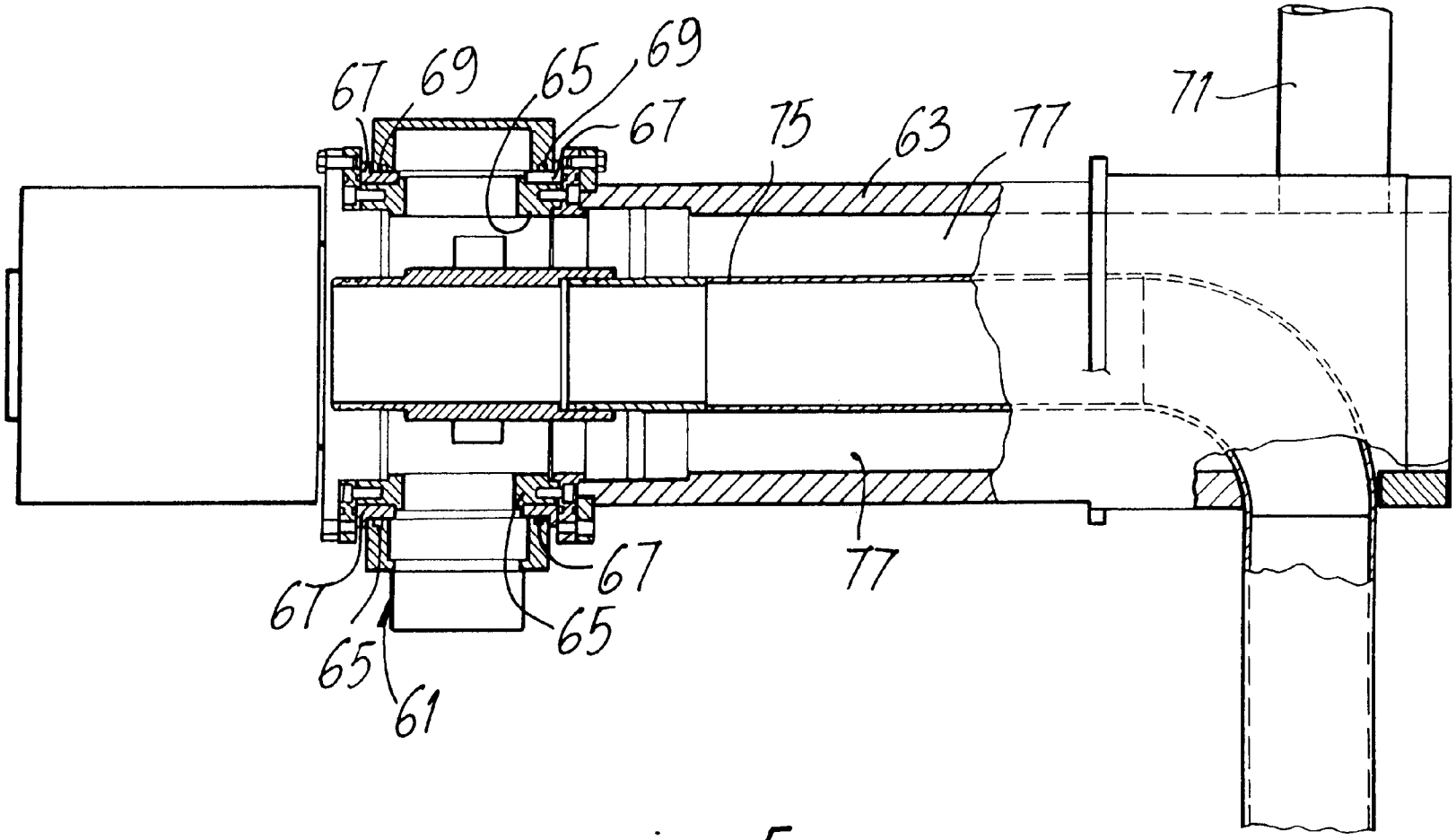
FIG. 5 is a sectional lateral elevation view of the collector device according to the invention.

Spray nozzles 51 are mounted on the opposite side of the discharge manifold 21, at each duct 19. The nozzles are connected to a high-pressure pump (not shown in the figures) and allow cleaning of the ducts internally along their entire length, as shown schematically in FIG. 4.

All the nozzles can be connected by means of a washing manifold 53 outside the container 2 in order to clean the ducts simultaneously.

The vacuum generator 3 includes a separator tank 25, which is connected to the manifold 23 and is suitable to collect the liquid product, and a vacuum pump 27, which is suitable to generate a partial vacuum inside the separator 25.

The vacuum pump 27 is of a per se known type. The separator 25 comprises a level monitoring device 37 which is suitable to control an extraction pump 39 in order to discharge the separated product when it reaches a preset level in the separator.

Downstream of the pump 39 there is a capacity meter 33 for automatically monitoring the amount of liquid product extracted.

This monitoring system is used to automatically control the press both during filling and during pressing, optimizing the partial vacuum values generated by the device 3.

A fan 41 is connected to the second chamber 17 of the container 2 and is adapted to generate a slight overpressure in the second chamber, whilst a valve 35 allows access to ambient pressure.

The operation of the separator according to the invention is as follows.

The pressing chamber 15 is initially filled with material to be separated, for example pressed or intact grapes; then a partial vacuum is generated in the discharge ducts 19 by means of the vacuum generator 3. The elastic diaphragm 9 then presses on the product due to the atmospheric pressure that is present in the second chamber 17. The liquid thus produced is conveyed into the manifold 23 and collected in the separator 25, where the extraction pump 39 discharges it periodically.

Optionally, the fan 41 can generate a slight overpressure in the second chamber 17 in order to facilitate the depletion of the product, generating a higher pressure differential between the pressing chamber and the second chamber.

The fan 41 is also advantageously used to quickly bring the diaphragm 9 to the operating position, in contact with the must, once filling has occurred.

Another advantageous use of the fan is to generate a partial vacuum in the second chamber in order to bring the diaphragm 9 to a position for loading the pressing chamber (as shown in FIG. 1).

The fan could in fact be used to feed air into the container; however, in this manner the juice might undergo oxidation due to contact with oxygen, and this process would be facilitated by the increase in the temperature of the gas inside the fan. According to the invention, this possible inconvenience has been obviated by allowing a repositioning of the elastic membrane, producing a partial vacuum in the second chamber 17 by means of a suction system which can use, for example, the fan 41 itself or a secondary suction system. This avoids contact with the product being processed and avoids the possible deterioration mentioned above.

According to the invention, a collector device is provided on the air intake pipe and is provided as a separate body so that it can also be fitted in existing machines in a simple manner and with a small number of modifications which can be performed at the installation site of the machine.

The collector device includes a connector or coupling 61, which is rigidly coupled to the support 7 of the frame of the machine, and an air intake pipe 63 which is associated with the tank 2 and rotates with it.

A ring 65 supports a bearing 67, which in turn rotates with respect to the fixed connector 61 by interposing gaskets 69 of the O-ring type which are suitable to ensure that the operating pressure is maintained inside the collector device.

A radial pipe 71 is connected to the second chamber 17 of the tank and to the air intake pipe 63, which is in turn connected to the fan 41 through the fixed connector 61. An internal coaxial pipe 75 forms an annular chamber 77 inside the air intake pipe 63. The internal coaxial pipe 75 has one end connected to the circular manifold 21 and the other end connected to the discharge manifold 23. The blower of fan 41 draws air from the second chamber 17 of the tank by means of the pipe 71, the annular chamber 77 and the connector 61, generating the partial vacuum that moves the membrane 9 so that it adheres to the tank. In order to maintain this position, a valve (not shown) is provided downstream of the connector 61; by closing, the valve maintains the partial vacuum in the ducts and in the tank.

It has been found in practice that the invention achieves the intended aim and objects, providing an apparatus for pressing fruit and the like which is structurally and functionally much more simplified than known devices and is also advantageous from the point of view of the quality of the resulting product.

The product is in fact subjected to less shear and to a higher degree of filtration with respect to conventional presses.

The advantages provided by the absence of high-pressure fluids are many: first of all, the apparatus does not require the inspections and tests prescribed by the law and most of all there is no danger of explosion or breakage in case of malfunction of valves and automatic systems, consequently providing complete safety for the operators and without safety and control devices.

An important advantage is due to the fact that in case of malfunctions of the diaphragm, no oil, compressed air or pressurized fluid can reach the food product, as instead occurs in conventional presses.

Another great advantage is due to the possibility to keep the apparatus in partial vacuum while filling it with product, thus assisting the feeding action, increasing the amount of product loaded for an equal volume, and facilitating the extraction of juice.

The apparatus according to the invention is subjected to less mechanical stress and is accordingly more reliable and has a longer operating life.

Another advantage is that it is possible to work on the apparatus even during processing, since there are no pressurized parts.

Figure 2:
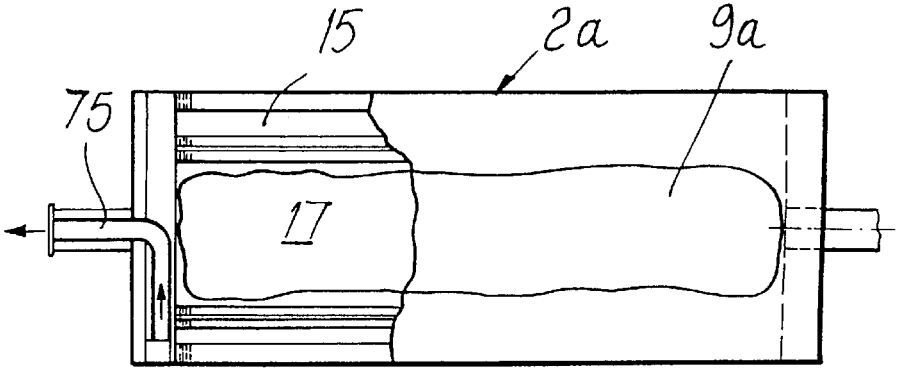
FIG. 2 is a schematic lateral elevation view of a container with a tubular diaphragm which can be applied to the apparatus according to the invention.

FIG. 2 illustrates, for example, a container 2*a* which includes an elastic diaphragm 9*a* of the tubular type, which forms a pressing chamber 15 which is coaxial to the second chamber 17.

In practice, in an apparatus according to the invention it is possible to use any kind of pressing container, which can also be noncylindrical and nonrotating.

The second chamber of the container can be open toward the outside.

FIG. 1 also illustrates a possible arrangement of the fan 41*a,* which is connected to the separator 25. In this case, the fan 41*a* would not be used to generate a slight overpressure in the second chamber, as described earlier, but would facilitate a first quick generation of partial vacuum in the pressing chamber, also bringing the diaphragm 9 quickly to the operating position. The fan 41*a,* in this case also, is capable of quickly bringing the diaphragm 9 to the loading position, shown in FIG. 1.

The same fan 41*a,* appropriately connected to a reservoir 29 of inert gas which also includes a discharge 31, allows to introduce gas in the pressure chamber to avoid the contact of the product with ambient air and therefore contain the oxidation of the product.

The materials used, as well as the dimensions, may of course be any according to the requirements and the state of the art.

What is claimed is:

1. An apparatus for separating liquid and solid substances, comprising:

a pressing container into which a product to be separated is fed, said pressing container including a rotatable cylinder which is divided by a flexible diaphragm into a pressing chamber and into a second chamber, said second chamber having a pressure which is at least atmospheric pressure during a pressing operation, said pressing chamber being connected to a vacuum means adapted to generate a partial vacuum, so that said diaphragm presses against the product in said pressing chamber during the pressing operation, said apparatus further comprising a collector device including a fixed connector which is rigidly coupled to a fixed body or support of the apparatus, an air intake pipe which is connected to said cylinder and rotates therewith, a radial tubular member which is connected to and communicates with said second chamber of said pressing container and said air intake pipe, said air intake pipe being connected to a fan through an air manifold, said collector device further including an internal coaxial pipe disposed coaxially inside said air intake pipe to form therewith an annular chamber, said fan being suitable or operable to draw air from said second chamber by means of said radial tubular member, said annular chamber, and said connector, generating a partial vacuum which is suitable to bring said diaphragm to a position which adheres to internal surfaces of said pressing container.

2. The apparatus according to claim 1, wherein said vacuum means includes a vacuum pump which is connected to a separator tank.

3. The apparatus according to claim 2, wherein said pressing chamber comprises discharge ducts which are connected to said tank by means of a discharge manifold, said second chamber being substantially at atmospheric pressure.

4. The apparatus according to claim 2, further comprising an overpressure producing fan which is connected to said separator tank and is adapted to generate a slight overpressure in said pressing chamber in order to move said diaphragm to a position which facilitates the feeding of said pressing chamber.

5. The apparatus according to claim 4, wherein said fan connected to said separator tank is adapted to generate a first rapid partial vacuum in said pressing chamber.

6. The apparatus according to claim 4, wherein said fan connected to said separator tank is adapted to introduce inert gas in said pressure chamber.

7. The apparatus according to claim 1, further comprising means operatively connected to said pressing container for generating a slight overpressure in said second chamber.

8. The apparatus according to claim 7, wherein said means for generating a slight overpressure includes an overpressure fan also adapted to generate a slight partial vacuum in said second chamber in order to facilitate the feeding of said product into said pressing chamber.

9. The apparatus according to claim 8 wherein said overpressure fan and said fan connected to said air intake pipe are the same fan.

10. The apparatus according to claim 8 wherein said overpressure fan and said fan connected to said air intake pipe are different fans.

11. The apparatus according to claim 1, wherein said second chamber is connected to a means adapted to generate pressure.

12. The apparatus according to claim 1, wherein said second chamber is open and is connected to the outside environment.

13. The apparatus according to claim 1, further comprising a device for checking extracted liquid product in order to optimize a pressing cycle.

* * * * *